US007267532B2

(12) United States Patent
Krebs

(10) Patent No.: US 7,267,532 B2
(45) Date of Patent: Sep. 11, 2007

(54) OFFSET-DRIVE MAGNETICALLY DRIVEN GEAR-PUMP HEADS AND GEAR PUMPS COMPRISING SAME

(75) Inventor: Larry F. Krebs, Vancouver, WA (US)

(73) Assignee: Micropump, Inc., a unit of IDEX Corporation, Vancouver, WA (US)

( * ) Notice: Subject to any disclaimer, the term of this patent is extended or adjusted under 35 U.S.C. 154(b) by 434 days.

(21) Appl. No.: 11/025,760

(22) Filed: Dec. 28, 2004

(65) Prior Publication Data

US 2006/0140793 A1 Jun. 29, 2006

(51) Int. Cl.
*F04B 17/00* (2006.01)

(52) U.S. Cl. ..... 417/420

(58) Field of Classification Search ..... 417/420
See application file for complete search history.

(56) References Cited

U.S. PATENT DOCUMENTS 2,460,371 A * 2/1949 Szwargulski ..... 310/54
3,986,797 A * 10/1976 Kopf ..... 417/420
4,127,365 A 11/1978 Martin et al.
5,423,661 A 6/1995 Gabeler et al.
5,540,569 A * 7/1996 Altham et al. ..... 417/420
5,702,234 A * 12/1997 Pieters ..... 417/53
5,725,362 A * 3/1998 Zepp et al. ..... 417/366
6,033,193 A 3/2000 Pieters et al.
6,106,240 A * 8/2000 Fischer et al. ..... 417/203
6,183,218 B1 * 2/2001 Ojima et al. ..... 417/410.4
6,551,070 B2 4/2003 Burns et al.
6,809,928 B2 10/2004 Gwin et al.
2004/0028537 A1 2/2004 Shulver et al.
2004/0052663 A1 3/2004 Laing et al.

* cited by examiner

*Primary Examiner*—William H. Rodriguez
(74) *Attorney, Agent, or Firm*—Klarquist Sparkman, LLP

(57) ABSTRACT

Magnetically driven gear-pump heads and pumps are disclosed. An exemplary gear-pump head includes a housing, a magnet cup, a pump driving gear, and a pump driven gear. The housing has a pump axis and defines a pump cavity. The magnet cup extends along the pump axis and contains a driven magnet that is rotatable inside the magnet cup about the pump axis. The driven magnet comprises a first driving gear. The pump driving gear has a first gear axis, and the pump driven gear has a second gear axis. The first gear axis is parallel to but laterally offset from the pump axis on a first side of the pump axis. The second gear axis is parallel to but laterally offset from the pump axis on a second side of the pump axis. The pump gears are situated in the pump cavity and interdigitate with each other such that rotation of the pump driving gear causes a corresponding contrarotation of the pump driven gear. The pump driving gear includes a second driving gear that interdigitates with the first driving gear such that rotation of the driven magnet causes, via the first and second driving gears, corresponding rotation of the pump driving gear and contrarotation of the pump driven gear to pump liquid through the pump housing.

64 Claims, 5 Drawing Sheets

OFFSET-DRIVE MAGNETICALLY DRIVEN GEAR-PUMP HEADS AND GEAR PUMPS COMPRISING SAME

FIELD

This disclosure pertains, inter alia, to gear pumps as used for pumping liquids and other fluids in a hydraulic system. More specifically, the disclosure pertains to such gear pumps that are magnetically driven and hermetically sealed.

BACKGROUND

For pumping liquids and other fluids, gear pumps have experienced substantial acceptance in the art due to their comparatively small size, quiet operation, reliability, and cleanliness of operation with respect to the fluid being pumped. Gear pumps also are advantageous for pumping fluids while keeping the fluids isolated from the external environment. This latter benefit has been further enhanced with the advent of magnetically coupled pump-drive mechanisms that have eliminated leak-prone hydraulic seals that otherwise would be required around pump-drive shafts.

Gear pumps have been adapted for use in many applications, including applications requiring extremely accurate delivery of a fluid to a point of use. Such applications include, for example, delivery of liquids in medical instrumentation. Another such application is the delivery of coolant liquids to a location where the coolant liquid can be used for active cooling or temperature control of an object.

In many microelectronic devices being produced currently, the relentless demand for increasingly more powerful and faster microprocessors has resulted in the development of microprocessor "chips" that include extremely large numbers (e.g., tens of millions) of active components such as transistors. Since each transistor draws some electrical current, each transistor dissipates some heat. Even though the amount of heat dissipated by a single transistor on a microprocessor chip is miniscule, in a chip that includes millions of transistors, the total heat generated by all the active circuit elements on the chip usually is so great that means must be provided for cooling the chip whenever power is being applied to it; otherwise, accumulated heat could or would destroy the chip. Until very recently, chip cooling has been passive, such as by placing a heat sink in contact with the chip package. In some instances, a heat sink having sufficient heat-removal capacity must be very large relative to the chip, which adds objectionable bulk to the electronic device including the chip. In other instances, using a heat sink that relies solely on passive conduction and convection of heat away from the chip is insufficient for adequate cooling, so a fan must be provided to pass air actively over the heat sink. Very recently, the heat-removal demands of certain microprocessor chips have increased to such an extent that liquid-cooling systems are being developed for cooling the chips. Heretofore, including liquid conduits in spaces occupied by delicate electronics has been avoided at all costs to avoid the catastrophic consequences of leaks. However, the demand for better cooling has forced equipment manufacturers to reconsider this old taboo and to find practical ways of employing liquid cooling while minimizing the probability of leaks and of ameliorating the consequences of leaks.

Other problems that have hindered more widespread employment of liquid cooling of microprocessor chips in microelectronic devices are the extremely tight space constraints that typically exist in such devices and the extremely high reliability specifications that must be met. Liquid cooling requires that liquid conduits and other passageways be provided to the chip, at the chip, and away from the chip. Liquid conduits occupy valuable space and typically provide many ways for liquid to leak from the hydraulic system. Another hindrance has been the additional costs associated with implementing a hydraulic cooling system in a microelectronic device. Yet another hindrance has been the demands on an energy budget posed by the need to run a pump or the like for cooling purposes. These problems can be especially taxing in applications such as lap-top computers in which available interior space and energy budgets are extremely limited.

Ongoing efforts to achieve wider implementation of liquid-cooling in microelectronic devices, especially in devices in which liquid cooling is the only practical option, have stimulated interest in various improvements to hydraulic systems to make these systems suitable for these and other demanding applications. A key focus in these endeavors is the need for smaller, more reliable, and more efficient gear pumps for use in these and other demanding applications.

SUMMARY

The needs summarized above, as well as other needs, are met by magnetically driven gear-pump heads, gear pumps, gear-pump assemblies, and hydraulic circuits as disclosed herein.

According to a first aspect of the disclosure, gear-pump heads are provided. An embodiment of such a gear-pump head comprises a pump housing, a driven magnet, a pump driving gear, and a pump driven gear. The pump housing has a pump axis and defines a pump cavity. The magnet extends along the pump axis and is rotatable about the pump axis. The driven magnet comprises a first driving gear. The pump driving gear has a first gear axis and includes a pump driven gear having a second gear axis. The first gear axis is parallel to but laterally offset from the pump axis on a first side of the pump axis, and the second gear axis is parallel to but laterally offset from the pump axis on a second side of the pump axis. The pump gears are situated in the pump cavity and are configured to interdigitate with each other such that rotation of the pump driving gear causes a corresponding contrarotation of the pump driven gear in the pump cavity. The pump driving gear comprises a second driving gear configured to interdigitate with the first driving gear such that rotation of the driven magnet causes, via the first and second driving gears, corresponding rotation of the pump driving gear and contrarotation of the pump driven gear in a manner by which liquid is pumped through the pump housing.

The gear-pump head further can comprise a magnet cup that extends along the pump axis and that contains the driven magnet. In this and other embodiments, the pump housing can comprise, along the pump axis, a first plate and a second plate, wherein the pump cavity is defined between the first and second plates. The magnet cup can extend from the first plate along the pump axis. Alternatively, the pump housing can comprise a plate situated along the pump axis between the pump cavity and the magnet cup, wherein the plate separates the magnet cup from the pump cavity. In this configuration the magnet and first driving gear are situated in the magnet cup, and the second driving gear extends through the plate so as to interdigitate with the first driving gear in the magnet cup.

In an embodiment the respective distances by which the first and second gear axes are laterally offset from the pump axis are equal to each other. In another embodiment the first and second gear axes are located symmetrically on opposite sides of the pump axis.

In an embodiment the pump housing can comprise, along the pump axis, a first plate and a second plate. In such a housing the pump cavity can be defined between the first and second plates. In another embodiment the pump housing comprises a first plate, a second plate, and a cavity portion situated between the first and second plates. In such a housing the pump cavity is defined along the pump axis in the cavity portion. In this latter embodiment the second plate and cavity portion can be integral with each other. Alternatively, the cavity portion can be configured as a cavity plate situated between the first and second plates. In another embodiment the first plate, cavity plate, and second plate are stacked along the pump axis and are fastened together axially in a hermetically sealed manner. The magnet cup desirably extends from the first plate along the pump axis.

In an embodiment the pump housing comprises a plate situated along the pump axis between the pump cavity and the magnet cup, wherein the plate separates the magnet cup from the pump cavity. The magnet and first driving gear are situated in the magnet cup, and the second driving gear extends through the plate so as to interdigitate with the first driving gear in the magnet cup.

In another embodiment the pump housing comprises a first plate, a second plate, and a cavity portion situated between the first and second plates. Thus, the first plate, second plate, and cavity portion collectively define the pump cavity that extends along the pump axis. The pump driving gear and pump driven gear are situated in and are interdigitated with each other in the pump cavity. The second driving gear extends through the first plate so as to interdigitate with the first driving gear in the magnet cup. In this configuration, at least one of the first and second plates can include a wear plate that serves to prevent excessive wear of the first and/or second plate by the rotating pump gears.

In another embodiment the pump housing comprises, along the pump axis, a first plate and a second plate, wherein the pump cavity is defined along the pump axis between the first and second plates. The pump driving gear comprises respective first and second journals and the pump driven gear comprises respective first and second journals. The first journals extend into respective bearings defined in the first plate, and the second journals extend into respective bearings defined in the second plate. At least one bearing can be an integrated bearing. Alternatively or in addition, at least one bearing can comprise a bearing insert.

Yet another embodiment comprises a liquid-circulation loop configured to circulate liquid around the journals in the bearings whenever the gear pump is pumping the liquid. The liquid-circulation loop can be further configured to circulate the liquid around the driven magnet whenever the gear pump is pumping the liquid. The liquid-circulation loop can comprise a respective axial bore defined in the pump driving gear and a respective axial bore defined in the pump driven gear, wherein the axial bores are configured to deliver the liquid to the respective bearings in the second plate. The liquid-circulation loop further can comprise at least one fluid conduit defined in and extending through the first plate, wherein the fluid conduit is situated and configured to deliver a portion of the liquid from the pump outlet to the magnet cup and from the magnet cup to the respective bearings in the first plate. In this latter configuration the axial bores deliver the liquid from the magnet cup to the respective bearings in the second plate.

Any of the embodiments of gear-pump heads can include a magnet shaft that extends in the magnet cup along the pump axis. The magnet shaft desirably is inserted into a corresponding axial bore defined in the driven magnet, so as to allow the driven magnet to rotate about the pump axis relative to the magnet shaft. Desirably, liquid is circulated around the driven magnet in the magnet cup whenever the gear pump is pumping the liquid.

Another embodiment of a magnetically driven gear-pump head comprises a pump housing, a magnet cup, a pump driving gear, a pump driven gear, and a bearing-flush circuit. The housing comprises a first plate and a second plate that define therebetween a pump cavity extending along a pump axis. The pump housing defines a pump inlet for delivering liquid into the pump housing and a pump outlet for delivering fluid from the pump housing. The magnet cup extends from the second plate and contains a driven magnet that is rotatable inside the magnet cup about the pump axis. The driven magnet comprises a first driving gear. The pump driving gear has a first gear axis and the pump driven gear has a second gear axis. The gear axes are parallel to but laterally offset from the pump axis on first and second sides, respectively, of the pump axis. The pump gears are contained in the pump cavity, journaled in respective bearings in the first and second plates, wherein rotation of the pump driving gear causes a corresponding contrarotation of the pump driven gear in the pump cavity. The pump driving gear comprises a second driving gear configured to interdigitate with the first driving gear such that rotation of the driven magnet causes, via the first and second driving gears, corresponding rotations of the pump driving gear and pump driven gear. The bearing-flush circuit is configured to flush the bearings of the pump gears with the liquid whenever the pump gears are rotating and pumping the liquid.

In another embodiment the pump housing further comprises a cavity portion situated on the pump axis between the first and second plates. This cavity portion, in cooperation with the first and second plates, defines the pump cavity. The cavity portion desirably is integral with at least one of the first and second plates.

A magnetically driven gear-pump head according to yet another embodiment comprises a pump housing, a magnet cup, a pump driving gear, a pump driven gear, and a rotational coupling. The pump housing comprises a first plate and a second plate that define therebetween a pump cavity extending along a pump axis. The pump housing defines a pump inlet for delivering liquid into the pump housing and a pump outlet for delivering fluid from the pump housing. The magnet cup extends from the second plate and contains a driven magnet that is rotatable inside the magnet cup about the pump axis. The pump driving gears have respective gear axes that are parallel to but laterally offset a distance from the pump axis on first and second sides, respectively, of the pump axis. The pump gears are contained in the pump cavity and are journaled in respective bearings in the first and second plates. Rotation of the pump driving gear causes a corresponding contrarotation of the pump driven gear in the pump cavity. The rotational coupling connects the driven magnet to the pump driving gear in a manner such that rotation of the driven magnet about the pump axis causes corresponding rotation of the pump driving gear about the first gear axis, which causes corresponding contrarotation of the pump driven gear about the second gear axis in a manner by which liquid is pumped through the pump housing from the pump inlet to the pump outlet. The gear-pump head of this embodiment can comprise a bearing-flush circuit, in the pump housing, that is configured to flush the bearings of the pump gears with the liquid during operation of the gear-pump head. The bearing-flush circuit can be further configured to flush the driven magnet and the rotational coupling with the liquid during operation of the gear-pump head.

A gear-pump head according to yet another embodiment comprises a pump housing having a pump axis and defining a pump cavity, a pump inlet, a pump outlet, and a magnet cup containing a driven magnet that is rotatable inside the magnet cup about the pump axis. The driven magnet comprises a first rotational-coupling means. In the pump housing is a pump driving gear having a first gear axis and a pump driven gear having a second gear axis. The first gear axis is parallel to but laterally offset from the pump axis on a first side of the pump axis, and the second gear axis is parallel to but laterally offset from the pump axis on a second side of the pump axis. The pump gears are situated in the pump cavity and are configured to interdigitate with each other such that rotation of the pump driving gear causes a corresponding contrarotation of the pump driven gear in the pump cavity. The pump driving gear comprises a second rotational-coupling means coupled to the first rotational-coupling means such that rotation of the driven magnet causes, via the first and second rotational-coupling means, corresponding rotation of the pump driving gear and contrarotation of the pump driven gear in a manner by which liquid is pumped through the pump housing from the pump inlet to the pump outlet.

According to another aspect, gear pumps are provided. Various embodiments of such gear pumps comprise at least one gear-pump head of any of the embodiments summarized above, and a "prime mover" situated and connected relative to the gear-pump head so as to cause rotation of the driven magnet whenever the prime mover is being energized. The prime mover in most instances is an electric motor, but such a configuration is not to be construed as limiting. In general, the prime mover is situated and configured to cause rotation of the driven magnet about the pump axis.

An embodiment of a gear pump comprises a magnetically driven gear-pump head comprising a pump housing, a pump inlet, a pump outlet, and a magnet cup. The pump housing has a pump axis and defines a pump cavity containing a pump driving gear and a pump driven gear. The magnet cup extends along the pump axis and contains a driven magnet that is rotatable inside the magnet cup about the pump axis. The pump driving gear has a first gear axis, and the pump driven gear has a second gear axis, wherein the first gear axis is parallel to but laterally offset a distance from the pump axis on a first side of the pump axis, and the second gear axis is parallel to but laterally offset the distance from the pump axis on a second side of the pump axis. The pump gears are interdigitated with each other as described above. The driven magnet comprises a first driving gear, and the pump driving gear comprises a second driving gear that is configured to interdigitate with the first driving gear such that rotation of the driven magnet causes, via the first and second driving gears, corresponding rotation of the pump driving gear and contrarotation of the pump driven gear. The gear pump also includes a prime mover situated and configured to cause rotation of the driven magnet.

The prime mover can comprise a driving magnet situated outside the magnet cup coaxially with the driven magnet, in which configuration the prime mover is configured to cause rotation of the driving magnet about the pump axis. The driving magnet is magnetically coupled to the driven magnet such that rotation of the driving magnet causes a corresponding rotation of the driven magnet about the pump axis.

In another embodiment the prime mover comprises an electric motor having an armature and a stator, wherein the driving magnet is coupled to the armature. In yet another embodiment the prime mover comprises an electric motor such as a brushless DC motor. In the latter case the brushless DC motor can comprise a stator that is situated coaxially and relative to the magnet cup such that the driven magnet serves as an armature for the stator, wherein energization of the stator causes rotation of the driven magnet about the pump axis.

Another aspect is directed, in a gear-pump head comprising a pump housing, pump driving gear, and pump driven gear as summarized above, having a respective gear axis that is parallel to the pump axis, to methods for driving the pump gears so as to cause liquid to flow through the pump cavity from an inlet to an outlet. An embodiment of such a method comprises disposing the pump gears in the pump cavity such that each of the respective gear axes is laterally offset from the pump axis on first and second sides, respectively, of the pump axis. A driven magnet is disposed on the pump axis in a manner allowing the driven magnet to rotate about the pump axis. The driven magnet is rotationally coupled to the pump driving gear such that rotation of the driven magnet about the pump axis causes corresponding rotation of the pump driving gear about its respective gear axis, which in turn causes contrarotation of the pump driven gear. The driven magnet is caused to rotate, which drives the pump gears.

Each of the pump gears can be journaled in respective bearings defined in the pump housing. Desirably, liquid is flushed through the bearings during use of the gear-pump head for pumping the liquid.

The driven magnet can be caused to rotate by attaching a driving magnet to an armature of an electric motor, the driving magnet being configured to magnetically couple to the driven magnet, and energizing the electric motor to cause rotation of the driving magnet. Alternatively, the driven magnet can be caused to rotate by placing a motor stator relative to the driven magnet in a manner such that energization of the motor stator causes a corresponding rotation of the driven magnet about the pump axis.

According to another aspect, hydraulic circuits are provided. An embodiment of such a circuit comprises a gear pump according to any of the embodiments herein. A first conduit leads from the gear pump to a location, and a second conduit leads from the location to the gear pump. The gear pump, whenever the prime mover is energized, urges flow of a liquid from the gear pump through the first conduit to the location and from the location through the second conduit to the gear pump. The location can be a locus (e.g., semiconductor "chip" or processor) requiring cooling by the liquid. The hydraulic circuit further can comprises a heat exchanger situated and configured to remove heat from the liquid that was transferred to the liquid at the locus. The prime mover can be configured to operate the gear pump and thus cause flow of the liquid whenever the locus requires cooling (e.g., whenever the locus is dissipating heat).

Another embodiment of a hydraulic circuit comprises a gear pump within the scope of the same as described herein. A first conduit leads from the gear pump to a location, and a second conduit leads from the location to the gear pump, wherein the gear pump, whenever the prime mover is energized, urges flow of a liquid from the gear pump through the first conduit to the location and from the location through the second conduit to the gear pump.

The hydraulic circuit further can include a heat exchanger situated and configured to remove heat from the liquid that was transferred to the liquid at the locus.

The foregoing and additional features and advantages of the invention will be more readily understood from the following detailed description, which proceeds with reference to the accompanying drawings.

DETAILED DESCRIPTION

As used herein, a "gear pump" encompasses any of various pumps utilizing at least two impellers or rotors (i.e., "gears") that are contrarotated relative to each other in a casing or housing, wherein at least one of the gears is a "driving" gear and the remaining gear(s) in the pump is a "driven" gear. Each gear has multiple teeth or lobes, oriented radially with respect to the axis of rotation of the gear, that interdigitate (i.e., "mesh") with corresponding teeth or lobes, respectively, in the mating gear. As the gears are contrarotated, fluid entering the space between the teeth or lobes of each gear is transported by the gears from an entrance ("inlet") port to a discharge ("outlet") port. The term "gear pump" also encompasses any of various "internal-gear" and "external gear" pumps as known in the art.

A "pump head" as used herein is an assembly comprising at least one functional gear pump that can be coupled to a motor or other prime mover to make the pump head operational (i.e., to apply an actuating force to the pump gears and cause them to rotate, thereby causing the pump head to function as a gear pump).

A "cavity pump" is a gear pump comprising at least two meshed contrarotatable gears situated in a gear cavity defined by a housing enclosing the meshed gears. During operation, fluid entering the cavity pump moves around the gear cavity in the spaces between the gear teeth or lobes to a discharge, or outlet, port of the gear cavity. A cavity pump is also termed an "external gear pump" in the art.

Figure 1:
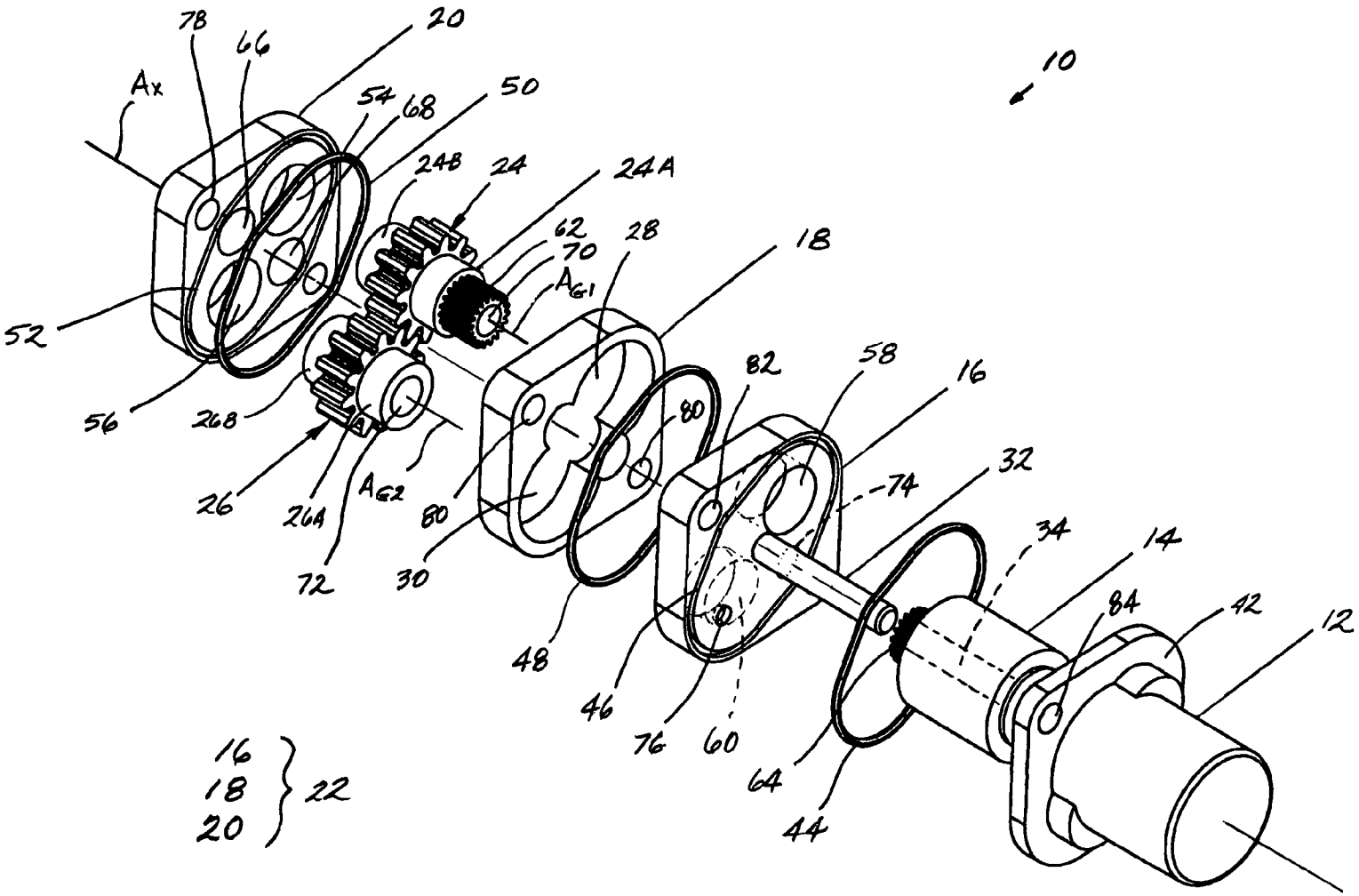
FIG. 1 is an isometric exploded view of a gear-pump head according to a first representative embodiment.

A first representative embodiment of an offset-drive gear pump 10 is shown in FIG. 1, which provides the depiction in an exploded view. Attention is first drawn to the axis Ax of the gear pump, along which axis the various parts are arranged in the exploded view. The gear pump 10 comprises a magnet cup 12, a driven magnet 14, a cover plate 16, a cavity plate 18, and a face plate 20 arranged along the axis Ax. The cover plate 16, cavity plate 18, and face plate 20 constitute a "pump housing" 22 in this embodiment. (The magnet cup 12 also can be considered as part of the pump housing.) The gear pump 10 also comprises a pump driving gear 24 and a pump driven gear 26 that, in the assembled gear pump 10, are situated in respective bores 28, 30 in the cavity plate 18 and rotate (when driven) about their respective axes $A_{G1}$, $A_{G2}$. The gear axes $A_{G1}$, $A_{G2}$ are parallel to, but laterally displaced from, the pump axis Ax. Most desirably, the gear axes $A_{G1}$, $A_{G2}$ are displaced equal distances from the pump axis Ax. With respect to a housing 22 containing a pump driving gear 24 and a single pump driven gear 26, the gear axes $A_{G1}$, $A_{G2}$ most desirably are on opposite respective sides of the pump axis Ax. If the housing 22 has multiple pump driven gears 26 interdigitated with the pump driving gear 24, the gear axes most desirably are parallel to and equi-angularly situated about the pump axis Ax. The bores 28, 30 have respective diameters that allow the respective pump gears 24, 26 to rotate unhindered about their respective axes $A_{G1}$, $A_{G2}$ while providing minimal back-leakage of liquid being pumped by the pump gears.

Figure 2:
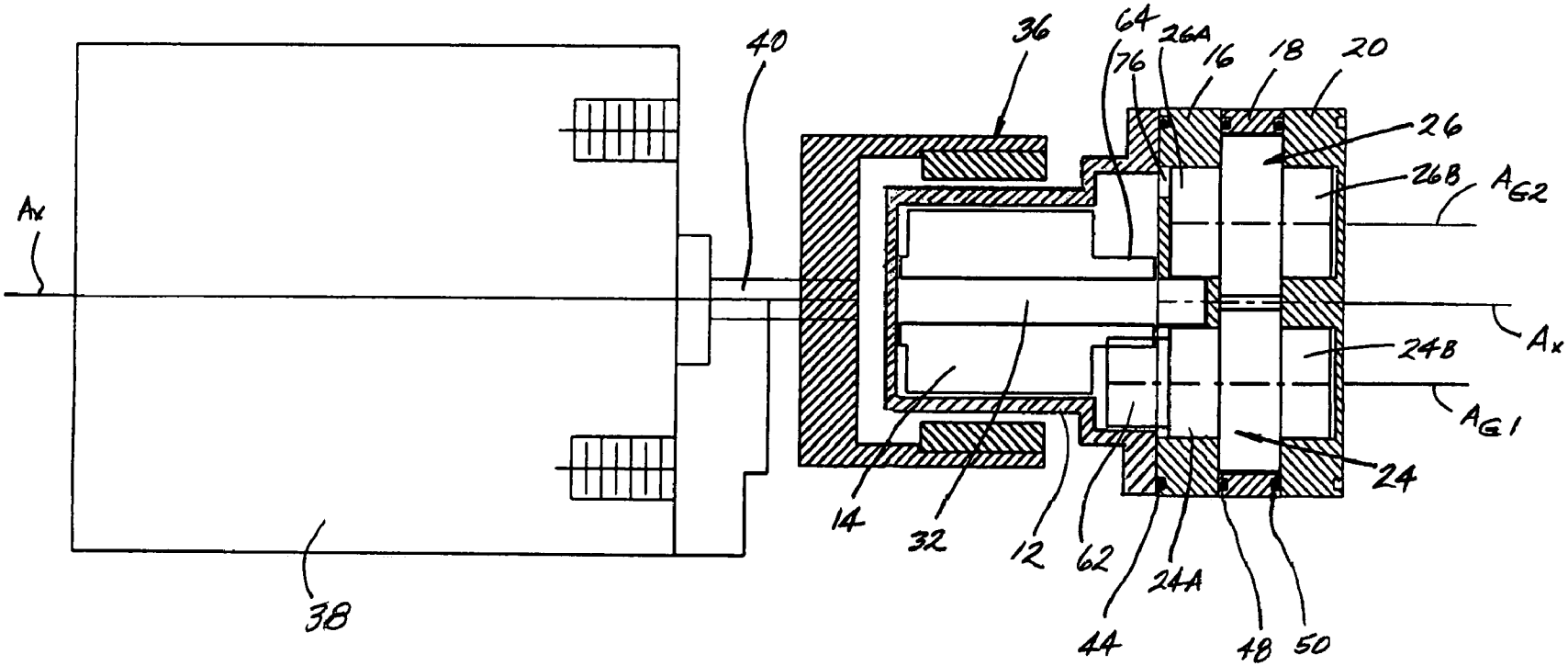
FIG. 2 is a elevational section depicting the gear-pump head of FIG. 1 attached to an electric motor (as a representative prime mover) having an armature to which a driving magnet is attached coaxially with the pump head.

The driven magnet 14 has a diameter slightly smaller than the inside diameter of the magnet cup 12, which allows the driven magnet 14 to be inserted, during assembly of the pump 10, into the magnet cup 12 with sufficient clearance for unhindered rotation of the driven magnet 14 inside the magnet cup 12 about the axis Ax while ensuring adequate magnetic coupling to a motor or other prime mover. Affixed to the cover plate 16 in this embodiment is a shaft 32 that is coaxial with the pump axis Ax and that extends toward and into the magnet cup 12. The driven magnet 14 defines an axial bore 34 having an inside diameter slightly greater than the outside diameter of the shaft 32, which allows the shaft 32 to be inserted into the bore 34 and the driven magnet 14 to rotate freely, on the shaft 32, about the pump axis Ax. As shown in FIG. 2, a driving magnet can be situated, on the pump axis Ax, outside the magnet cup 12. The magnetic field produced by the driving magnet 36 passes through the magnet cup 12 and engages the magnetic field of the driven magnet 14, thereby magnetically coupling the driven magnet 14 to the driving magnet 36. Hence, as the driving magnet 36 rotates about the pump axis Ax, the driven magnet 14 concurrently rotates about the pump axis Ax. Rotation of the driving magnet 36 is achieved using an electrical motor 38 or other suitable prime mover. With most types of suitable electric motors, the driving magnet 36 is mounted coaxially to the armature shaft 40 of the motor 38.

In an alternative embodiment, a motor stator (especially of a brushless DC motor) can be situated coaxially and in radially surrounding relationship to the magnetic cup such that the driven magnet actually serves as the armature of the motor. This configuration, termed an "integrated"-motor configuration, eliminates the need for a driving magnet 36, thereby allowing the motor-pump assembly to be made more compact, especially in the axial dimension.

The magnet cup 12 includes a mounting flange 42 shaped and configured to mate coaxially with the cover plate 16. To create a seal between the mounting flange 42 and the cover plate 16, a respective O-ring 44 or analogous static seal means is used. The O-ring 44 is nested in a respective gland 46 defined in the cover plate 16 (as shown) or in the mounting flange 42. Similarly, to create a seal between the cover plate 16 and the cavity plate 18, a respective O-ring 48 or analogous static seal means is used. The O-ring 48 is nested in a respective gland defined in the cover plate 16 or in the cavity plate 18. Similarly, to create a seal between the cavity plate 18 and the face plate 20, a respective O-ring 50 or other static seal means is used. The O-ring 50 is nested in a respective gland 52 defined in the face plate 20 (as shown) or in the cavity plate 18.

Referring further to FIG. 1, the pump driving gear 24 and pump driven gear 26 each comprise a respective pair of journals 24A and 24B, 26A, 26B, one on each axial end of the respective gear 24, 26. The journals 24B, 26B on the distal side of the pump gears as shown are inserted, during assembly of the pump, into respective bearings 54, 56 defined in the face plate 20. The journals 24A, 26A on the proximal side of the pump gears 24, 26 as shown are inserted, during assembly of the pump, into respective bearings 58, 60 defined in the cover plate 16. Each journal 24A, 26A, 24B, 26B is accommodated in its respective journal bearing 54, 56, 58, 60 with sufficient clearance to allow flush liquid to bathe the journal and bearing during rotation of the pump gears 24, 26, as described later below. In this embodiment, the bearings 54, 56 in the face plate 20 are blind, and the bearings 58, 60 in the cover plate 16 are not, which facilitates flushing of the bearings, as described later below.

Figure 4:
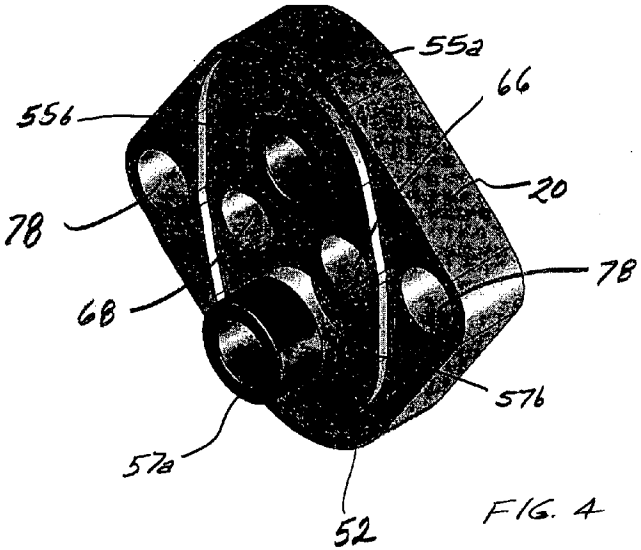
FIG. 4 is an isometric view of an exemplary face plate including bearing inserts.

Although not required for all applications, one or more of the bearings 54, 56, 58, 60 can include a respective bearing insert that confers enhanced strength and/or durability to the bearing. An example is shown in FIG. 4, which depicts bearing inserts 55*a*, 57*a* inserted into respective bores 55*b*, 57*b*, respectively, in the face plate 20 to form the bearings 54, 56, respectively. Each bearing insert 55*a*, 57*a* has an inside diameter into which the respective journal 24B, 26B is inserted. Typically, the bearing inserts 55*a*, 57*a* are press-fit into the respective bores 55*b*, 57*b*. Exemplary bearing inserts include, but are not limited to, sintered copper, ceramic, other metal, other polymer, and carbon-containing (graphite-containing) materials. Bearings that do not have a bearing insert are termed "integrated" bearings. Eliminating a bearing insert by using an integrated bearing where possible reduces parts count and thus reduces cost. On the other hand, use of bearing inserts (especially in embodiments in which the cover plate and face plate are made of a relatively soft material such as a plastic material) can substantially increase bearing life, which is a key design consideration with respect to pumps used in a high-reliability application.

The pump driving gear 24 includes a first driving gear 62 extending axially (in a proximal direction as shown) from the proximal journal 24A. Similarly, the driven magnet 14 includes a second driving gear 64 extending axially (in a distal direction as shown) from the driven magnet 14. The first and second driving gears 62, 64 have respective teeth that interdigitate (mesh). Thus, whenever the proximal journal 24A of the pump driving gear 24 is inserted into the respective bearing 58 defined in the cover plate 16, and the magnet shaft 32 is fully inserted coaxially into the driven magnet 14, rotation of the driven magnet 14 causes rotation of the pump driving gear 24 and thus contrarotation of the pump driven gear 26. Although the first and second driving gears 62, 64 are shown as having the same length, diameter, and number of teeth, any of these parameters (especially diameter and number of teeth) can be changed as required for specific applications. Also, the first and second driving gears 62, 64 need not be made of the same material or by the same fabrication method.

In the depicted embodiment the face plate 20 defines an inlet port 66 and an outlet port 68. The inlet port 66 allows liquid, to be pumped, to enter the gear pump 10. The outlet port 68 discharges liquid pumped by the gear pump 10. Hence, during operation of the pump 10, the outlet port 68 typically is at a higher pressure than the inlet port 66. This pressure differential is exploited for bathing, using the fluid being pumped by the pump 10, the gear bearings 54, 56, 58, 60, the driven magnet 14, and the driving gears 62, 64. To such end, defined in each of the pump driving gear 24 and pump driven gear 26 is a respective axial bore 70, 72 that extends the full length of the respective pump gear 24, 26 and journals 24A, 24B, 26A, 26B (and first gear 62 on the pump driving gear 24). Also, the cover plate 16 defines a first bore 74 providing a fluid conduit from the outlet port 68 through the cover plate 16 to the magnet cup 12, and a second bore 76 providing a fluid conduit from the magnet cup 12 through the cover plate 16 to the proximal bearing 26A for the pump driven gear 26. The second bore 76, although shown having a cylindrical profile, alternatively can be configured as a slot or other suitable shape. A slot is advantageous because it allows, without having to remove a large amount of material from the cover plate 16, introduction of liquid to both the bore 76 and the journal 26A of the pump driven gear 26.

During operation of the pump 10, a small portion of the liquid being pumped by the pump passes from the higher pressure outlet port 68 through the first bore 74 in the cover plate 16 to the inside of the magnet cup 12. The liquid thus continuously bathes the inside of the magnet cup 12 as well as the driven magnet 14 with liquid. The liquid exits the magnet cup 12 (a) through the proximal bearing 58 for the pump driving gear 24 (thereby bathing the proximal bearing 58), (b) through the second bore 76 to the proximal bearing 60 for the pump driven gear 26 (thereby bathing the proximal bearing 60), (c) through the axial bore 70 of the pump driving gear 24 to the distal bearing 54 for the pump driving gear 24 (thereby bathing the distal bearing 54), and (d) through the axial bore 72 of the pump driven gear 26 to the distal bearing 56 for the pump driven gear 26 (thereby bathing the distal bearing 56). After circulating through the bearings 54, 56, 58, 60 in this manner, most of the liquid passes to the inlet port 66 and thus recirculates through the pump 10, and some of the bathing liquid passes out of the pump 10 through the outlet port 68. This circulation of liquid through the bearings 54, 56, 58, 60 entrains in the liquid any debris that may have deposited in the bearings, flushes the debris from the bearings, and provides a liquid cushion between the journals and the respective bearings. Note that the bathing liquid also flows past the first and second driving gears 62, 64.

The face plate 20, cavity plate 18, cover plate 16, and magnet cup 12 can be made of any suitable material such as, but not limited to, a rigid metal (desirably a metal that does not corrode in the presence of the liquid being pumped), a ceramic material, or a rigid polymeric ("plastic") material. Specific examples of these materials include, but are not limited to, stainless steel, aluminum alloy, polyetheretherketone (PEEK), poly(p-phenylene sulfide) (PPS), and polyimide. Plastic materials can be reinforced with any of various suitable fibers or particles.

Figure 5:
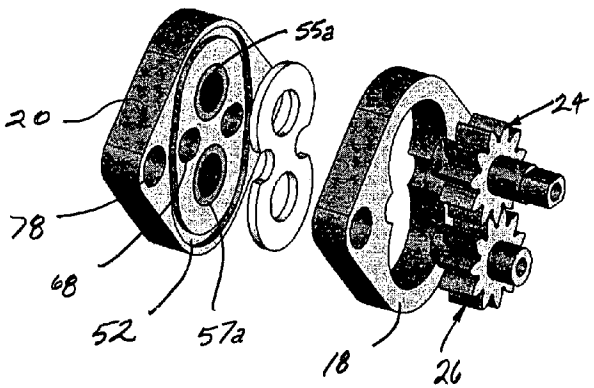
FIG. 5 is a perspective view of an exemplary face plate including a wear plate.

If the cavity plate 18 and face plate 20 are made of a polymeric material (which is softer than ceramic and most metal materials), increased wear resistance can be realized (especially in regions contacted by the contrarotating pump gears) by providing the respective faces of these plates with a wear plate. An example is shown in FIG. 5, in which a thin wear plate 77 is positioned between the pump gears 24, 26 and the face plate 20). The wear plate 77 is made of a suitably hard and resilient material such as ceramic.

The pump driving gear 24 and pump driven gear 26 can be made of any suitable material such as a metal, ceramic, or plastic as noted above. Metal parts can be machined or cast (e.g., by investment casting, the latter being followed by finish machining, as required). Ceramics can be case and/or machined. With respect to any of these components made from a plastic material, the plastic can be partially or completely molded to the respective configurations. For example, the components can be molded, followed by finish machining, or made entirely by molding without any need for secondary machining. Alternatively, they can be made entirely by machining, which is usually a more expensive fabrication method than molding. Hence, molding is advantageous, especially for plastics, if reducing cost is important.

The O-rings 44, 48, 50 can be made of any of various suitable elastomers such as, but not limited to, any of various "rubber" or silicone materials. The magnet shaft 32 can be made of metal, plastic, or other rigid and durable material such as sapphire. The driven magnet 14 comprises a permanent magnet that desirably produces a strong magnetic field per unit mass. A suitable magnet material in this regard is samarium cobalt (SMCO), but any of various other magnet materials alternatively can be used. The driven magnet 14 may be at least partially encapsulated in a suitable material such as plastic if desired or required. Alternatively, if the driven magnet 14 is unharmed by the liquid being pumped by the pump 10, the driven magnet 14 need not be encapsulated. See examples below for various material configurations that can be used.

Each of the face plate 20, cavity plate 18, cover plate 16, and flange 42 of the magnet cup 12 defines respective mounting holes 78, 80, 82, 84 each configured to accommodate a respective screw or analogous fastener (not shown) used for holding the pump assembly together. Alternatively, the pump assembly can be held together using clamps or the like.

Although the subject pump was developed in response to a need for a small pump that can be used in a highly confined space for pumping liquid for use in cooling microprocessor chips and the like, the pump is not to be regarded as limited to this specific application. The pump configuration readily allows any of various expansions or contractions in scale, and can be used advantageously in any of a wide variety of applications, including applications not characterized by confined space.

The motor 38 desirably is an electric motor or hydraulic motor. If the motor 38 is electric, it can be configured to operate on AC or DC current, brushed or brushless, and can be configured to run on any suitable magnitude of voltage. The motor 38 desirably is specified so as to be capable of running the pump 10 at the desired pump rate for the desired length of time at the desired operating temperature and at high reliability. A particularly desirable motor configuration is that of a brushless DC motor. Such a motor can include the driving magnet affixed to the armature of the motor.

Figure 6:
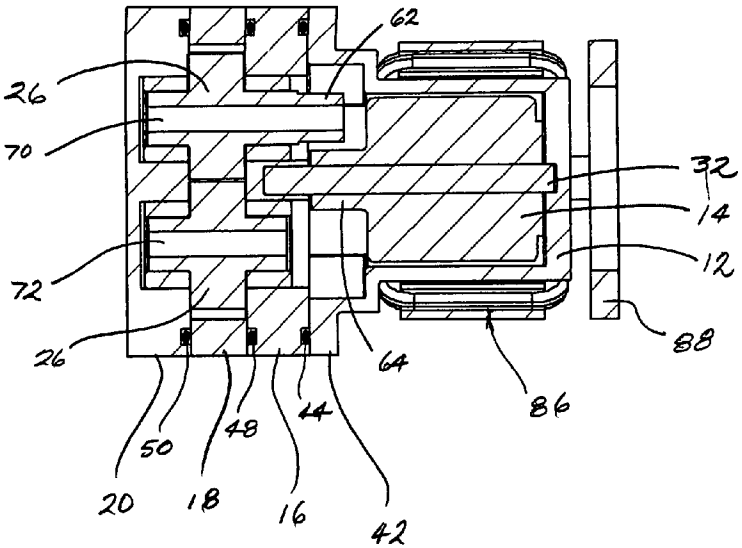
FIG. 6 is an elevational section depicting a gear-pump head attached to a stator of a brushless motor, the stator being arranged in a radially surrounding relationship to the magnet cup (and hence to the driven magnet, which serves as the armature of the stator).

Alternatively, as noted earlier above, the motor 38 can be configured as an "integrated" brushless DC motor (such as a stepper motor) that requires no driving magnet per se because the "integrated" motor utilizes the driven magnet 14 as the armature of the motor. An example is shown in FIG. 6, in which the magnet cup 12 is radially surrounded by a stator 86 of a brushless DC motor arranged coaxially with the magnet cup 12 and driven magnet 14. The stator 86 is held in place by a backing plate 88 that desirably is in a coaxially "stacked" relationship, along the axis Ax, with the plates 16, 18, 20. The integrated-motor configuration is highly desirable because the stator 88 occupies substantially less space than a motor including an armature to which a driving magnet 36 is affixed. Either configuration also can include any of various controls and encoders that provide motor feed-back signals.

The motor 38 need not be coupled directly axially to the driving magnet 14. Alternatively, the motor 38 can be coupled using a 90-degree or other angled gear coupling, using a belt and pulley, using a flexible coupling, or using any of various other dynamic-coupling schemes known in the art of machine design.

The driven magnet 14 can be journaled in an alternative manner that eliminates the shaft 32. For example, the driven magnet 14 can be provided with an axially proximal journal and an axially distal journal, wherein the axially proximal journal seats in a respective bearing on the inside end wall of the magnet cup 12, and the axially distal journal seats in a respective bearing on the facing wall of the cover plate 16.

In another alternative embodiment, the first and second driving gears 62, 64 are replaced by any of various other rotational couplings known in the art such as respective pulleys and interconnecting belt. Gears are desirable in many applications because they achieve the desired rotational coupling of the driven magnet and pump driving gear in minimal space.

Figure 3:
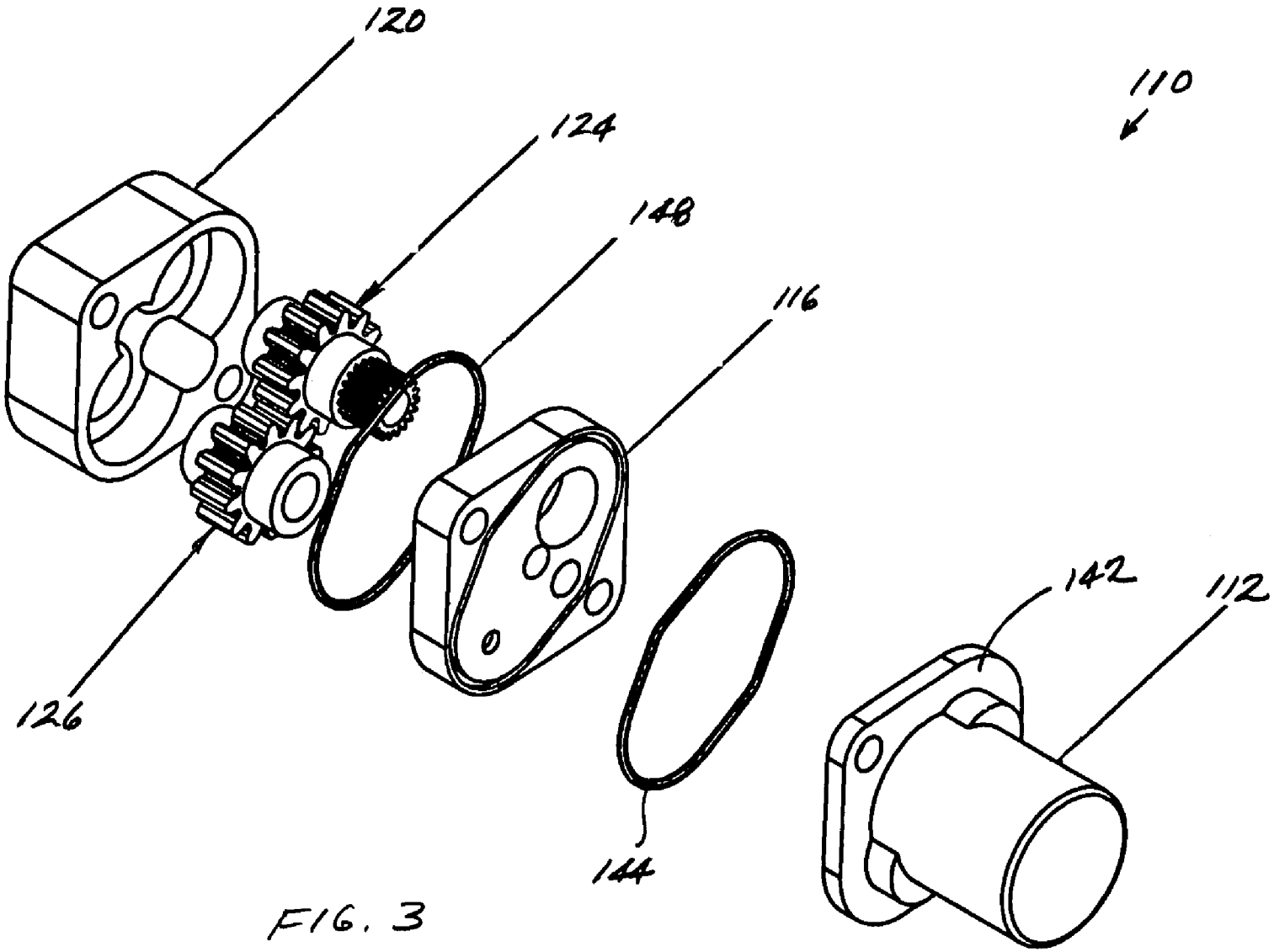
FIG. 3 is an isometric exploded view of a gear-pump head according to a second representative embodiment.

A second representative embodiment of a pump-head 110 is shown, as an exploded view, in FIG. 3. (In FIG. 3, certain details understandable from FIG. 1 are not shown, such as the driven magnet 14 and shaft 32.) The embodiment of FIG. 3 is similar to the embodiment of FIG. 1 except that, in the FIG. 3 embodiment, the face plate and cavity plate are integrated into a single plate unit 120. This embodiment may be beneficial for certain applications because it eliminates the separate face plate and cavity plate, and thus eliminates a passive seal (the O-ring 50) between the face plate 20 and cavity plate 18 in the embodiment of FIG. 1. Desirably, in the FIG. 3 embodiment, the gland for the O-ring 148 between the plate unit 120 and the cover plate 116 desirably is defined in the distal (as shown) face of the cover plate 116. Also shown in FIG. 3 is the O-ring 144 between the cover plate 116 and the flange 142 of the magnet cup 112, as well as the pump driving gear 124 and pump driven gear 126.

In an alternative embodiment to either FIG. 1 or FIG. 2, the pump driving gear 24 can include a direct-drive shaft (not shown) to which the pump driving gear 24 and first driving gear 62 are affixed. However, advantages of the configuration shown in FIG. 1 are a lower parts count and easy accommodation of the axial bore 70 in the pump driving gear 24.

In yet another alternative embodiment (not shown), the journals 24A, 24B, 26A, 26B are eliminated in a configuration in which each of the pump driving and driven gears 24, 26 includes a respective fixed shaft on which the respective gear rotates (not shown).

Figure 7:
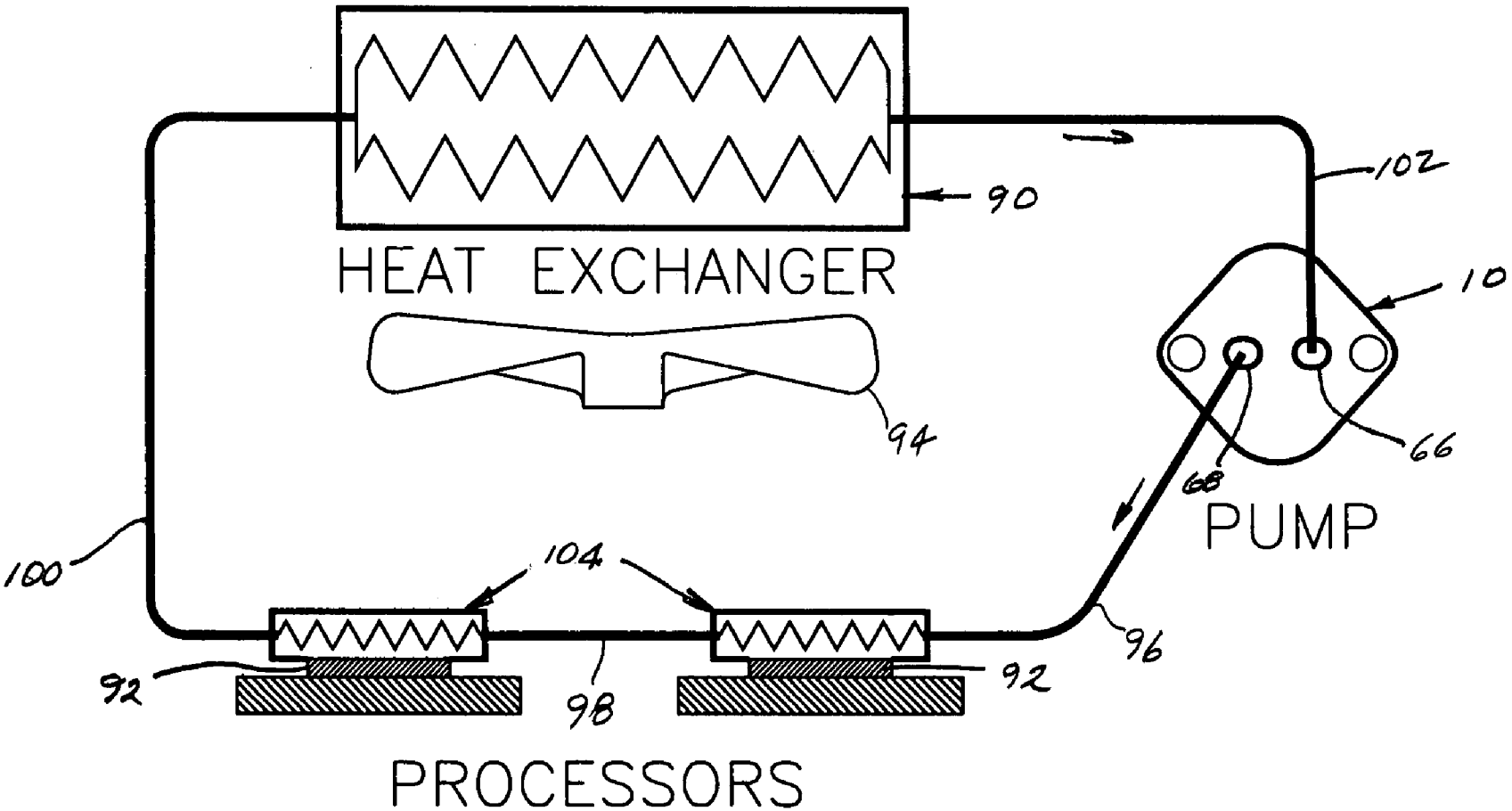
FIG. 7 is a schematic hydraulic-circuit diagram of a gear-pump head connected in an exemplary hydraulic circuit for cooling one or more microprocessor chips.

FIG. 7 depicts an exemplary circuit for cooling semiconductor chips. Shown are a pump 10 as described above, a heat-exchanger 90, and two "processors" 92 (microprocessor chips requiring cooling). The outlet port 68 of the pump 10 is connected hydraulically to the processors 92 (shown connected in series, but this manner of connection is not to be regarded as limiting). Downstream of the processors 92 is the heat exchanger 90. The heat exchanger 90 is depicted as including a fan 94, but it will be understood that the heat exchanger alternatively can include a passive heat-radiating structure, for example, for dumping excess heat. The pump 10, processors 92, and heat exchanger 90 are hydraulically connected together in the circuit by hydraulic lines 96, 98, 100, 102. Each of the processors 92 includes a respective heat-exchange medium 104. Coolant liquid pumped from the outlet port 68 of the pump 10 passes through the hydraulic line 96 to the first-processor heat-exchange medium 104. In the first-processor heat-exchange medium 104, heat produced by the first processor is conducted to the liquid, thereby cooling the processor 92 and warming the liquid. The liquid in the depicted circuit passes through the hydraulic line 98 to the second-processor heat-exchange medium 104. In the second-processor heat-exchange medium 104, heat produced by the second processor 92 is conducted to the liquid, thereby cooling the second processor 92 and further warming the liquid. The liquid then passes through the hydraulic line 100 to the heat exchanger 90 which removes heat from the liquid, which then flows through the hydraulic line 102 to the inlet port 66 of the pump 10. The pump 10 recirculates the liquid back to the processors 92.

Any of the pumps disclosed herein can include any of various other components, such as at least one suction shoe as known in the art (see U.S. Pat. No. 4,127,365 to Martin et al., incorporated herein by reference), especially if the application requires a suction shoe(s) and the space constraints or other limitations of the application can accommodate it or them.

EXAMPLE 1

This example is tabulated in Table 1, below, in which "PEEK" denotes polyetheretherketone, "316 SS" denotes 316 stainless steel, "EP" denotes ethylene propylene, and "SMCO" denotes samarium cobalt:

TABLE 1

| Configuration | Component | Material | Mfg Method | Notes |
|---|---|---|---|---|
| Embod. 1 or 2 | Face plate | PEEK | Machined | Integ'd bearing |
| | Cavity plate | PEEK | Machined | |
| | Driving gear | PEEK | Molded | |
| | Driven gear | PEEK | Molded | |
| | 1st gear | PEEK | Molded | |
| | 2nd gear | PEEK | Molded | |
| | O-rings | EP | Molded | |
| | Cover plate | PEEK | Machined | Integ'd bearing |
| | Magnet shaft | 316 SS | Machined | |
| | Driven magnet | PEEK, 316 SS SMCO | Molded | |
| | Magnet cup | PEEK | Machined | |

EXAMPLE 2

This example is tabulated in Table 2, below, wherein "PEEK", "EP", "316 SS", and "SMCO" are as defined above, and "AET" denotes an alternative engineering thermoplastic blend:

TABLE 2

| Configuration | Component | Material | Mfg Method | Notes |
|---|---|---|---|---|
| Embod. 1 or 2 | Face plate | PEEK | Machined | +Brg insert |
| | Cavity plate | PEEK | Machined | |
| | Driving gear | AET | Machined | |
| | Driven gear | AET | Machined | |
| | 1st gear | AET | Machined | |
| | 2nd gear | PEEK | Molded | |
| | O-rings | EP | Molded | |
| | Cover plate | PEEK | Machined | +Brg insert |
| | Magnet shaft | Sapphire | Formed | |
| | Driven magnet | PEEK, 316 SS SMCO | Molded | |
| | Magnet cup | PEEK | Machined | |

TABLE 2-continued

| Configuration | Component | Material | Mfg Method | Notes |
|---|---|---|---|---|
| | | | | |

EXAMPLE 3

This example is tabulated in Table 3, below, wherein "PEEK", "EP", and "316 SS" are defined above:

TABLE 3

| Configuration | Component | Material | Mfg Method | Notes |
|---|---|---|---|---|
| Embod. 1 or 2 | Face plate | PEEK | Molded | Integ'd bearing |
| | Cavity plate | PEEK | Molded | |
| | Driving gear | PEEK | Molded | |
| | Driven gear | PEEK | Molded | |
| | 1st gear | PEEK | Molded | |
| | 2nd gear | PEEK | Molded | |
| | O-rings | EP | Molded | |
| | Cover plate | PEEK | Molded | |
| | Magnet shaft | 316 SS, sapph | Machined | |
| | Driven magnet | PEEK, ceramic | Molded | Ceramic mag. |
| | Magnet cup | PEEK | Molded | |

EXAMPLE 4

This example is tabulated in Table 4, below, wherein "PEEK", "316 SS", "AET", "EP" are defined above:

TABLE 4

| Configuration | Component | Material | Mfg Method | Notes |
|---|---|---|---|---|
| Embod. 1 | Face plate | PEEK | Molded | +Brg insert |
| | Cavity plate | 316 SS | Machined | +Ceramic wear plate |
| | Driving gear | AET | Molded | |
| | Driven gear | AET | Molded | |
| | 1st gear | AET | Molded | |
| | 2nd gear | AET | Molded | |
| | O-rings | EP | Molded | |
| | Cover plate | PEEK | Molded | +Brg insert |
| | Magnet shaft | Sapphire | Formed | |
| | Driven magnet | AET, ceramic | Molded | Ceramic mag |
| | Magnet cup | PEEK | Molded | |

EXAMPLES 5 AND 6

These examples are directed to specific pump configurations and their respective parametric and performance data, as set forth in Table 5, in which "CD" denotes continuous duty:

TABLE 5

| Parameter | Example 5 | Example 6 |
|---|---|---|
| Pressure Drop | 130 kPa | 460 kPa |
| Flow rate | 110 mL/min | 220 mL/min |
| Height | 1.5 cm | 4 cm |

TABLE 5-continued

| Parameter | Example 5 | Example 6 |
|---|---|---|
| Length | 4 cm | 8 cm |
| Width | 1.5 cm | 4 cm |
| Target operating life | 7 years (CD) | 7 years (CD) |
| Power consumption | <1 Watt | <10 Watts |
| Seal | Hermetic | Hermetic |

The described embodiments are for illustrative purposes only and are not to be regarded as limiting in any way. The embodiments described herein can be subject to any of various modifications and changes without departing from the spirit or scope of the claims below. Included within the scope of the following claims are all such modifications that come within the spirit and scope of said claims.

What is claimed is:

1. A magnetically driven gear-pump head, comprising:

a pump housing having a pump axis and defining a pump cavity;

a driven magnet that is rotatable about the pump axis, the driven magnet comprising a first driving gear; and a pump driving gear having a first gear axis and a pump driven gear having a second gear axis, the first gear axis being parallel to but laterally offset from the pump axis on a first side of the pump axis, and the second gear axis being parallel to but laterally offset from the pump axis on a second side of the pump axis, the pump gears being situated in the pump cavity and being configured to interdigitate with each other such that rotation of the pump driving gear causes a corresponding contrarotation of the pump driven gear in the pump cavity, the pump driving gear comprising a second driving gear configured to interdigitate with the first driving gear such that rotation of the driven magnet causes, via the first and second driving gears, corresponding rotation of the pump driving gear and contrarotation of the pump driven gear in a manner by which liquid is pumped through the pump housing.

2. The gear-pump head of claim 1, further comprising a magnet cup extending along the pump axis and containing the driven magnet.

3. The gear-pump head of claim 2, wherein:

the pump housing comprises, along the pump axis, a first plate and a second plate;

the pump cavity is defined between the first and second plates; and the magnet cup extends from the first plate along the pump axis.

4. The gear-pump head of claim 2, wherein:

the pump housing comprises a plate situated along the pump axis between the pump cavity and the magnet cup, the plate separating the magnet cup from the pump cavity;

the magnet and first driving gear are situated in the magnet cup; and the second driving gear extends through the plate so as to interdigitate with the first driving gear in the magnet cup.

5. The gear-pump head of claim 1, wherein:

the first gear axis is laterally offset a given distance from the pump axis; and the second gear axis is laterally offset the distance from the pump axis.

6. The gear-pump head of claim 1, wherein the first and second gear axes are located symmetrically on opposite sides of the pump axis.

7. The gear-pump head of claim 1, wherein:

the pump housing comprises, along the pump axis, a first plate and a second plate; and the pump cavity is defined between the first and second plates.

8. The gear-pump head of claim 1, wherein:

the pump housing comprises a first plate, a second plate, and a cavity portion situated between the first and second plates; and the pump cavity is defined along the pump axis in the cavity portion.

9. The gear-pump head of claim 8, wherein the second plate and cavity portion are integral with each other.

10. The gear-pump head of claim 8, wherein the cavity portion is configured as a cavity plate situated between the first and second plates.

11. The gear-pump head of claim 10, wherein the first plate, cavity plate, and second plate are stacked along the pump axis and are fastened together axially in a hermetically sealed manner.

12. The gear-pump head of claim 1, wherein:

the pump housing comprises a first plate, a second plate, and a cavity portion situated between the first and second plates, the first plate, second plate, and cavity portion collectively defining the pump cavity extending along the pump axis;

the pump driving gear and pump driven gear are situated in and are interdigitated with each other in the pump cavity; and the second driving gear extends through the first plate so as to interdigitate with the first driving gear.

13. The gear-pump head of claim 12, wherein at least one of the first and second plates includes a wear plate.

14. The gear-pump head of claim 1, wherein:

the pump housing comprises, along the pump axis, a first plate and a second plate, wherein the pump cavity is defined along the pump axis between the first and second plates;

the pump driving gear comprises respective first and second journals;

the pump driven gear comprises respective first and second journals;

the first journals extend into respective bearings defined in the first plate; and the second journals extend into respective bearings defined in the second plate.

15. The gear-pump head of claim 14, wherein at least one bearing is an integrated bearing.

16. The gear-pump head of claim 15, wherein at least one bearing comprises a bearing insert.

17. The gear-pump head of claim 14, further comprising a liquid-circulation loop configured to circulate liquid around the journals in the bearings whenever the gear pump is pumping the liquid.

18. The gear-pump head of claim 17, wherein the liquid-circulation loop is further configured to circulate the liquid around the driven magnet whenever the gear pump is pumping the liquid.

19. The gear-pump head of claim 17, wherein the liquid-circulation loop comprises a respective axial bore defined in the pump driving gear and a respective axial bore defined in the pump driven gear, the axial bores being configured to deliver the liquid to the respective bearings in the second plate.

20. The gear-pump head of claim 19, wherein;

the liquid-circulation loop further comprises at least one fluid conduit defined in and extending through the first plate, the fluid conduit being situated and configured to deliver a portion of the liquid from the pump outlet to the driven magnet and from the driven magnet to the respective bearings in the first plate; and the axial bores deliver the liquid from the magnet to the respective bearings in the second plate.

21. The gear-pump head of claim 1, further comprising a magnet shaft extending along the pump axis, the magnet shaft being inserted into a corresponding axial bore defined in the driven magnet, so as to allow the driven magnet to rotate about the pump axis relative to the magnet shaft.

22. The gear pump of claim 1, further configured to circulate liquid around the driven magnet whenever the gear pump is pumping the liquid.

23. The gear pump of claim 22, wherein:

the pump driving gear comprises respective first and second journals;

the pump driven gear comprises respective first and second journals; and the journals extend into respective bearings defined in the pump housing, the gear pump being further configured to circulate liquid around the journals in the bearings whenever the gear pump is pumping the liquid.

24. A gear pump, comprising:

the gear-pump head of claim 1; and a prime mover situated and connected relative to the gear-pump head so as to cause rotation of the driven magnet whenever the prime mover is being energized.

25. The gear pump of claim 24, wherein the prime mover is an electric motor situated and configured to cause rotation of the driven magnet about the pump axis.

26. A magnetically driven gear-pump head, comprising:

a pump housing comprising a first plate and a second plate that define therebetween a pump cavity extending along a pump axis, the pump housing defining a pump inlet for delivering liquid into the pump housing and a pump outlet for delivering fluid from the pump housing;

a magnet cup extending from the second plate and containing a driven magnet that is rotatable inside the magnet cup about the pump axis, the driven magnet comprising a first driving gear;

a pump driving gear having a first gear axis and a pump driven gear having a second gear axis, the gear axes being parallel to but laterally offset from the pump axis on first and second sides, respectively, of the pump axis, the pump gears being contained in the pump cavity, being journaled in respective bearings in the first and second plates, and being configured to interdigitate with each other such that rotation of the pump driving gear causes a corresponding contrarotation of the pump driven gear in the pump cavity, the pump driving gear comprising a second driving gear configured to interdigitate with the first driving gear such that rotation of the driven magnet causes, via the first and second driving gears, corresponding rotations of the pump driving gear and pump driven gear in a manner by which liquid is pumped through the pump housing from the pump inlet to the pump outlet; and a bearing-flush circuit configured to flush the bearings of the pump gears with the liquid whenever the pump gears are rotating and pumping the liquid.

27. The gear-pump head of claim 26, wherein the magnet cup extends from the second plate coaxially from the pump axis.

28. The gear-pump head of claim 26, wherein each of the first and second gear axes is situated a distance from the pump axis.

29. The gear-pump head of claim 26, wherein the second driving gear is configured to extend through the second plate and interdigitate with the first driving gear in the magnet cup.

30. The gear-pump head of claim 26, wherein the pump housing further comprises a cavity portion situated on the pump axis between the first and second plates and that, cooperatively with the first and second plates, defines the pump cavity.

31. The gear-pump head of claim 30, wherein the cavity portion is integral with at least one of the first and second plates.

32. A gear pump, comprising:

the gear-pump head of claim 26; and a prime mover situated and connected relative to the gear-pump head so as to cause rotation of the driven magnet whenever the prime mover is being energized.

33. The gear pump of claim 32, wherein the prime mover is an electric motor situated and configured to cause rotation of the driven magnet about the pump axis.

34. The gear-pump head of claim 26, wherein the bearing-flush circuit is contained in the pump housing.

35. The gear-pump head of claim 26, wherein the bearing-flush circuit is configured also to flush the driven magnet and the first and second driving gears with the liquid during operation of the gear-pump head.

36. A magnetically driven gear-pump head, comprising:

a pump housing comprising a first plate and a second plate that define therebetween a pump cavity extending along a pump axis, the pump housing defining a pump inlet for delivering liquid into the pump housing and a pump outlet for delivering fluid from the pump housing;

a magnet cup extending from the second plate and containing a driven magnet that is rotatable inside the magnet cup about the pump axis;

a pump driving gear having a first gear axis and a pump driven gear having a second gear axis, the gear axes being parallel to but laterally offset a distance from the pump axis on first and second sides, respectively, of the pump axis, the pump gears being contained in the pump cavity, being journaled in respective bearings in the first and second plates, and being configured to interdigitate with each other such that rotation of the pump driving gear causes a corresponding contrarotation of the pump driven gear in the pump cavity; and a rotational coupling connecting the driven magnet to the pump driving gear in a manner such that rotation of the driven magnet about the pump axis causes corresponding rotation of the pump driving gear about the first gear axis, which causes corresponding contrarotation of the pump driven gear about the second gear axis in a manner by which liquid is pumped through the pump housing from the pump inlet to the pump outlet.

37. The gear-pump head of claim 36, further comprising a bearing-flush circuit in the pump housing configured to flush the bearings of the pump gears with the liquid during operation of the gear-pump head.

38. The gear-pump head of claim 37, wherein the bearing-flush circuit is further configured to flush the driven magnet and the rotational coupling with the liquid during operation of the gear-pump head.

39. A gear pump, comprising:

the gear-pump head of claim 36; and a prime mover situated and connected relative to the gear-pump head so as to cause rotation of the driven magnet whenever the prime mover is being energized.

40. The gear pump of claim 39, wherein the prime mover is an electric motor situated and configured to cause rotation of the driven magnet about the pump axis.

41. A gear pump, comprising:

a magnetically driven gear-pump head comprising a pump housing having a pump axis and defining a pump cavity containing a pump driving gear and a pump driven gear; a pump inlet; a pump outlet; and a magnet cup extending along the pump axis and containing a driven magnet that is rotatable inside the magnet cup about the pump axis, the driven magnet comprising a first driving gear;

the pump driving gear having a first gear axis and the pump driven gear having a second gear axis, the first gear axis being parallel to but laterally offset a distance from the pump axis on a first side of the pump axis, and the second gear axis being parallel to but laterally offset the distance from the pump axis on a second side of the pump axis, the pump gears being interdigitated with each other in the pump cavity such that rotation of the pump driving gear causes a corresponding contrarotation of the pump driven gear in the pump cavity;

the pump driving gear comprising a second driving gear configured to interdigitate with the first driving gear such that rotation of the driven magnet causes, via the first and second driving gears, corresponding rotation of the pump driving gear and contrarotation of the pump driven gear in a manner by which liquid is pumped through the pump housing from the pump inlet to the pump outlet; and a prime mover situated and configured to cause rotation of the driven magnet.

42. The gear pump of claim 41, wherein:

the prime mover comprises a driving magnet situated outside the magnet cup coaxially with the driven magnet;

the prime mover is configured to cause rotation of the driving magnet about the pump axis; and the driving magnet is magnetically coupled to the driven magnet such that rotation of the driving magnet causes a corresponding rotation of the driven magnet about the pump axis.

43. The gear pump of claim 41, wherein:

the prime mover comprises an electric motor having an armature and a stator; and the driving magnet is coupled to the armature.

44. The gear pump of claim 41, wherein the prime mover comprises an electric motor.

45. The gear pump of claim 44, wherein the electric motor is a brushless DC motor.

46. The gear pump of claim 45, wherein:

the brushless DC motor comprises a stator that is situated coaxially and relative to the magnet cup such that the driven magnet serves as an armature for the stator; and energization of the stator causes rotation of the driven magnet about the pump axis.

47. A gear-pump head, comprising:

pump-housing means having a pump axis and defining a pump cavity, a pump inlet, a pump outlet, and a magnet-enveloping means containing a driven magnet that is rotatable inside the magnet-enveloping means about the pump axis, the driven magnet comprising a first rotational-coupling means; and a pump driving gear having a first gear axis and a pump driven gear having a second gear axis, the first gear axis being parallel to but laterally offset from the pump axis on a first side of the pump axis, and the second gear axis being parallel to but laterally offset from the pump axis on a second side of the pump axis, the pump gears being situated in the pump cavity and being configured to interdigitate with each other such that rotation of the pump driving gear causes a corresponding contrarotation of the pump driven gear in the pump cavity, the pump driving gear comprising a second rotational-coupling means coupled to the first rotational-coupling means such that rotation of the driven magnet causes, via the first and second rotational-coupling means, corresponding rotation of the pump driving gear and contrarotation of the pump driven gear in a manner by which liquid is pumped through the pump-housing means from the pump inlet to the pump outlet.

48. A gear pump, comprising:

a gear-pump head as recited in claim 47; and a prime mover situated and configured to cause, whenever the prime mover is energized, rotation of the driven gear.

49. A gear-pump head, comprising:

pump-housing means having a pump axis and defining a pump cavity, a pump inlet, a pump outlet, and a magnet-enveloping means containing a driven magnet that is rotatable inside the magnet-enveloping means about the pump axis, the driven magnet comprising a rotational-coupling means;

a pump driving gear having a first gear axis and a pump driven gear having a second gear axis, the first gear axis being parallel to but laterally offset from the pump axis on a first side of the pump axis, and the second gear axis being parallel to but laterally offset from the pump axis on a second side of the pump axis, the pump gears being situated in the pump cavity and being configured to interdigitate with each other such that rotation of the pump driving gear causes a corresponding contrarotation of the pump driven gear in the pump cavity; and offset-drive means coupling the driven magnet to the pump driving gear, such that rotation of the driven magnet about the pump axis causes corresponding rotation of the pump driving gear about the first gear axis, which causes a corresponding contrarotation of the pump driven gear about the second gear axis in a manner by which liquid is pumped through the pump-housing means from the pump inlet to the pump outlet.

50. In a gear-pump head comprising a pump housing having a pump axis and defining a pump cavity, a pump driving gear having a respective gear axis that is parallel to the pump axis, and a pump driven gear having a respective gear axis that is parallel to the pump axis, a method for driving the pump gears so as to cause liquid to flow through the pump cavity from an inlet to an outlet, the method comprising:

disposing the pump gears in the pump cavity such that each of the respective gear axes is laterally offset from the pump axis on first and second sides, respectively, of the pump axis;

disposing a driven magnet on the pump axis in a manner allowing the driven magnet to rotate about the pump axis;

rotationally coupling the driven magnet to the pump driving gear such that rotation of the driven magnet about the pump axis causes corresponding rotation of the pump driving gear about its respective gear axis, which in turn causes contrarotation of the pump driven gear; and causing rotation of the driven magnet.

51. The method of claim 50, further comprising:

journaling each of the pump gears in respective bearings defined in the pump housing; and flushing liquid through the bearings during use of the gear-pump head for pumping the liquid.

52. The method of claim 50, wherein the driven magnet is caused to rotate by:

attaching a driving magnet to an armature of an electric motor, the driving magnet being configured to magnetically couple to the driven magnet; and energizing the electric motor to cause rotation of the driving magnet.

53. The method of claim 50, wherein the driven magnet is caused to rotate by placing a motor stator relative to the driven magnet in a manner such that energization of the motor stator causes a corresponding rotation of the driven magnet about the pump axis.

54. A hydraulic circuit, comprising:

a gear pump as recited in claim 41;

a first conduit leading from the gear pump to a location; and a second conduit leading from the location to the gear pump, wherein the gear pump, whenever the prime mover is energized, urges flow of a liquid from the gear pump through the first conduit to the location and from the location through the second conduit to the gear pump.

55. The hydraulic circuit of claim 54, wherein the location is a locus requiring cooling by the liquid.

56. The hydraulic circuit of claim 55, further comprising a heat exchanger situated and configured to remove heat from the liquid that was transferred to the liquid at the locus.

57. The hydraulic circuit of claim 55, wherein the locus is at a semiconductor chip.

58. The hydraulic circuit of claim 55, wherein the prime mover is configured to operate the gear pump and thus cause flow of the liquid whenever the locus requires cooling.

59. The hydraulic circuit of claim 55, wherein the prime mover is configured to operate the gear pump and thus cause flow of the liquid whenever the locus is dissipating heat.

60. A hydraulic circuit, comprising:

a gear pump as recited in claim 41;

a first conduit leading from the gear pump to a location; and a second conduit leading from the location to the gear pump, wherein the gear pump, whenever the prime mover is energized, urges flow of a liquid from the gear pump through the first conduit to the location and from the location through the second conduit to the gear pump.

61. The hydraulic circuit of claim 60, wherein the location is a locus requiring cooling by the liquid.

62. The hydraulic circuit of claim 61, further comprising a heat exchanger situated and configured to remove heat from the liquid that was transferred to the liquid at the locus.

63. The hydraulic circuit of claim 61, wherein the locus is at a semiconductor chip.

64. The hydraulic circuit of claim 61, wherein the prime mover is configured to operate the gear pump and thus cause flow of the liquid whenever the locus is dissipating heat sufficiently to require cooling.

* * * * *